US006609312B1

(12) United States Patent
Ellis, III

(10) Patent No.: US 6,609,312 B1
(45) Date of Patent: Aug. 26, 2003

(54) SHOE SOLE STRUCTURES USING A THEORETICALLY IDEAL STABILITY PLANE

(75) Inventor: Frampton E. Ellis, III, Arlington, VA (US)

(73) Assignee: Anatomic Research Inc., Arlington, VA (US)

( * ) Notice: Subject to any disclaimer, the term of this patent is extended or adjusted under 35 U.S.C. 154(b) by 0 days.

(21) Appl. No.: 08/162,373

(22) Filed: Dec. 3, 1993

Related U.S. Application Data

(63) Continuation of application No. 07/847,832, filed on Mar. 9, 1992, now abandoned, which is a continuation of application No. 07/469,313, filed on Jan. 24, 1990, now abandoned.

(51) Int. Cl.[7] ..... A43B 13/18
(52) U.S. Cl. ..... 36/25 P
(58) Field of Search ..... 36/25 R, 30 R, 36/28, 31, 32 R, 88, 91, 114, 127, 129, 69

(56) References Cited

U.S. PATENT DOCUMENTS

| | | | |
|---|---|---|---|
| 280,791 A | 7/1883 | Brooks | |
| 500,385 A | 6/1893 | Hall | |
| 584,373 A | 6/1897 | Kuhn | |

(List continued on next page.)

FOREIGN PATENT DOCUMENTS

| | | | |
|---|---|---|---|
| CA | 1176458 | 10/1984 | |
| DE | B23257 | * 5/1956 | ..... 36/25 |
| DE | 1685260 | 5/1966 | |
| DE | 3245182 | 12/1982 | |
| DE | 3317462 | 5/1983 | |
| EP | 0 069 083 | 1/1983 | |
| GB | 9591 | 11/1913 | |
| GB | 471179 | 8/1937 | |
| GB | 764956 | 1/1957 | |
| GB | 2 113 072 | 8/1983 | |
| IT | 443702 | 1/1949 | |
| WO | WO 83/03528 | 10/1983 | |
| WO | WO 87/07479 | 12/1987 | |
| WO | 8707480 | * 12/1987 | |

OTHER PUBLICATIONS

Runner's World, Feb. 1975, pp. 24 & 25.
Sports Illustrated, undated article from late 1988.
Runner's World, Jul. 1977, p. 16.
Eastbay Summertime '89 Catalogue, pp. 12 &13.
Runner's World, Mar. 1988, pp. 64,65, and 98.
*Runner's World*, 11/88, p. 75.
*Runner's World*, 10/87, p. 60.
*In Search of the Perfect Shoe*, joe Henderson, Runner's World Magazine, Feb. 1975, pp. 24 and 25.
Adidas Track Spikes (see photos); sale dated, pre–Jan. 24, 1989.

*Primary Examiner*—Ted Kavanaugh

(57) ABSTRACT

A construction for a shoe, particularly an athletic shoe such as a running shoe, includes a sole that is constructed according to the applicant's prior invention of a theoretically ideal stability plane. Such a shoe sole according to that prior invention conforms to the natural shape of the foot, particularly the sides, and that has a constant thickness in frontal plane cross sections; the thickness of the shoe sole sides contour equals and therefore varies exactly as the thickness of the load-bearing sole portion. The new invention relates to the use of the theoretically ideal stability plane concept to provide natural stability in negative heel shoe soles that are less thick in the heel area than in the rest of the shoe sole. This new invention also relates to the use of the theoretically ideal stability plane concept to provide natural stability in flat shoe soles that have no heel lift, maintaining the same thickness throughout; such a design avoids excessive structural rigidity by using contoured stability sides abbreviated to only essential structural support elements to provide the shoe sole with natural flexibility paralleling that of the human foot. The abbreviation of essential structural support elements can also be applied to negative heel shoe soles, again to avoid excessive rigidity and to provide natural flexibility.

16 Claims, 8 Drawing Sheets

U.S. PATENT DOCUMENTS 811,438 A 1/1906 Rhodes
1,870,751 A 8/1932 Reach
2,095,095 A * 10/1937 Howard
2,120,987 A 6/1938 Murray
2,124,986 A 7/1938 Pipes
2,155,166 A 4/1939 Kraft
2,162,912 A 6/1939 Craver
2,179,942 A * 11/1939 Lyne
2,201,300 A 5/1940 Prue
2,206,860 A 7/1940 Sperry
2,251,468 A 8/1941 Smith
2,284,307 A 5/1942 Sperry
2,328,242 A * 8/1943 Witherill ..... 36/59
2,345,831 A 4/1944 Pierson
2,470,200 A 5/1949 Wallach
2,518,649 A * 8/1950 Tydings et al. ..... 36/11.5
2,627,676 A 2/1953 Hack
2,847,769 A * 8/1958 Schlesinger
3,087,261 A 4/1963 Russell
3,295,230 A 1/1967 Szerenyi et al.
3,305,947 A * 2/1967 Kalsoy ..... 36/11.5
3,732,634 A 5/1973 Jacobson
3,824,716 A 7/1974 Di Paolo
3,834,046 A 9/1974 Fowler
3,964,181 A * 6/1976 Holcombe, Jr. ..... 36/91
4,059,910 A 11/1977 Bryden et al.
4,149,324 A * 4/1979 Lesser et al.
4,281,467 A 8/1981 Anderie
4,309,831 A 1/1982 Pritt
4,309,832 A 1/1982 Hunt
4,455,767 A * 6/1984 Bergmanns ..... 36/28
4,468,870 A 9/1984 Sternberg
4,542,598 A 9/1985 Misevich et al.
4,547,979 A 10/1985 Harada et al.
4,559,723 A 12/1985 Hamy et al.
4,569,142 A 2/1986 Askinasi
4,570,362 A 2/1986 Vermonet
4,620,376 A 11/1986 Talarico, II
4,624,061 A 11/1986 Wezel et al.
4,638,577 A 1/1987 Riggs
4,654,983 A 4/1987 Graham et al.
4,667,423 A 5/1987 Autry et al.
4,715,133 A * 12/1987 Hartjes et al.
4,724,622 A 2/1988 Mills
4,731,939 A 3/1988 Parracho et al.
4,748,753 A * 6/1988 Ju ..... 36/127
4,777,738 A 10/1988 Giese et al.
4,783,910 A 11/1988 Boys, II et al.
4,790,083 A 12/1988 Dufour
4,858,340 A * 8/1989 Pasternak ..... 36/88
4,864,737 A 9/1989 Marrello
4,866,861 A * 9/1989 Noone
4,890,398 A 1/1990 Thomasson
4,894,932 A 1/1990 Harada et al.
4,934,073 A * 6/1990 Robinson ..... 36/91
4,989,349 A * 2/1991 Ellis, III ..... 36/25 R
5,012,597 A 5/1991 Thomasson
5,014,449 A 5/1991 Richard et al.
5,025,573 A 6/1991 Giese et al.
5,048,203 A 9/1991 Kling
5,224,810 A 7/1993 Pitkin
5,317,819 A * 6/1994 Ellis, III ..... 36/25 R
5,544,429 A * 8/1996 Ellis, III ..... 36/30 R
5,909,948 A * 6/1999 Ellis, III

* cited by examiner

FIG. 9A
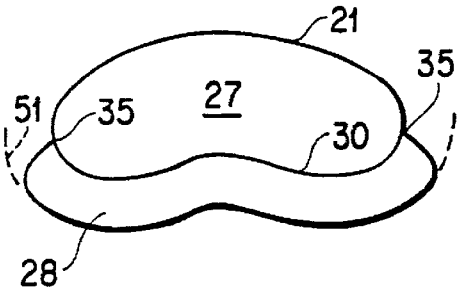
FIG. 9B
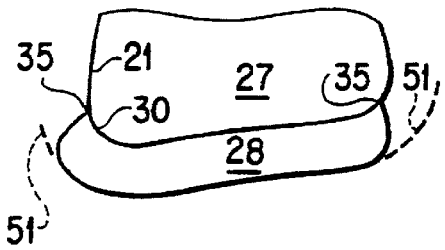
FIG. 9C
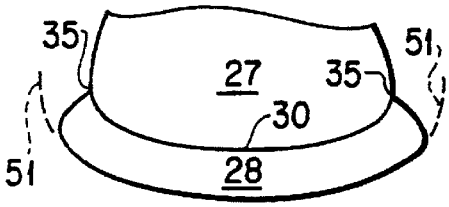
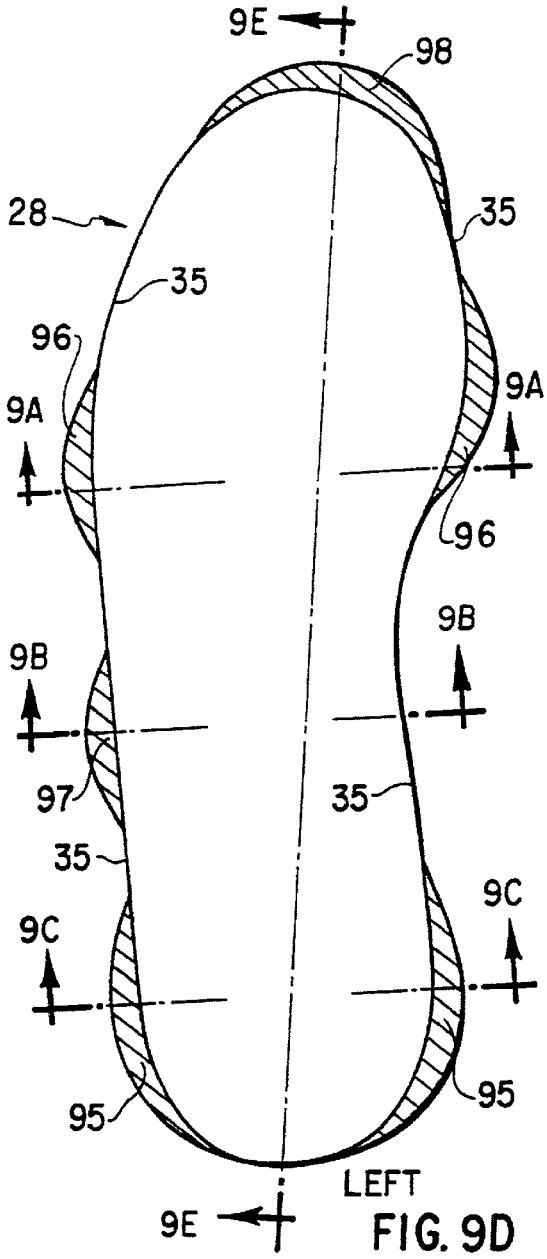
FIG. 9D
FIG. 9E
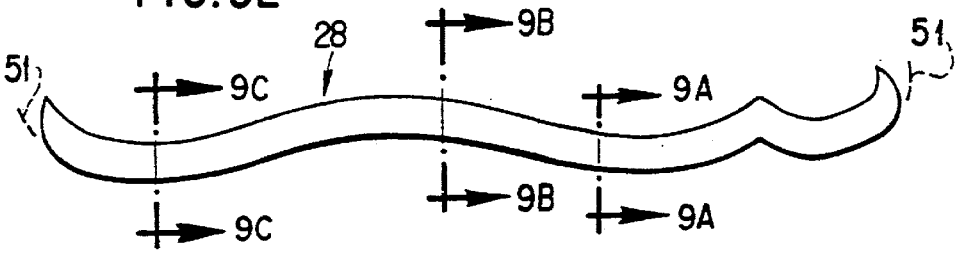

SHOE SOLE STRUCTURES USING A THEORETICALLY IDEAL STABILITY PLANE

This is a continuation of application Ser. No. 07/847,832, filed Mar. 9, 1992, now abandoned, which is a continuation of application Ser. No. 07/469,313, filed Jan. 24, 1990, now abandoned.

BACKGROUND OP THE INVENTION

This invention relates generally to the structure of shoes. More specifically, this invention relates to the structure of athletic shoes. Still more particularly, this invention relates to variations in the structure of such shoes using the applicant's prior invention of a theoretically-ideal stability plane as a basic concept. Still more particularly, this invention relates to the use of the theoretically ideal stability plane concept to provide stability in(negative heel shoe soles that are less thick in the heel area than in the rest of the shoe sole. Still more particularly, this invention also relates to the use of the theoretically ideal stability plane concept to provide natural stability in flat shoe soles that have no heel lift, thereby maintaining the same thickness throughout; excessive structural rigidity being avoided with contoured stability sides abbreviated to only essential structural support elements to provide the shoe sole with natural flexibility paralleling that of the human foot.

The applicant has introduced into the art the general concept of a theoretically ideal stability plane as a structural basis for shoe designs. That concept as implemented into shoes such as street shoes and athletic shoes is presented in pending U.S. application Nos. U.S. Pat. No. 4,989,349, issued Feb. 5, 1991 U.S. Pat. No. 5,317,819, issued Jun. 7, 1994 U.S. Pat. No. 5,544,429 issued Aug. 13, 1996, and in Ser. No. 07/239,667, filed on Sep. 2, 1988 now abandoned; Ser. No. 07/400,714, filed on Aug. 30, 1989 now abandoned; Ser. No. 07/416,478, filed on Oct. 3, 1989 now abandoned, Ser. No. 07/424,509, filed Oct. 20, 1989 now abandoned, and Ser. No. 07/463,302, filed Jan. 10, 1989 now abandoned, as well as in PCT Application No. PCT/US89/03076 filed on Jul. 14, 1989, which is generally comprised of the virtually the entire '819 Patent verbatim (FIGS. 1–28) and major portions of the '349 Patent also verbatim (FIGS. 29–37) and was published as International Publication Numbers WO 90/00358 on Jan. 25, 1990; PCT Application No. PCT/US90/04917, which is comprised verbatim of the '714 application, except for FIGS. 13–15 (which were published as FIGS. 38–40 of WO 90/00358) and was published as WO 91/03180 on Mar. 21, 1991; PCT Application No. PCT/US910/05609, which is comprised verbatim of the '478 application and was published as WO 91/04683 on Apr. 18, 1991; PCT Application No. PCT/US90/06028, which is comprised verbatim of the '509 application and was published as WO 91/05491 on May 2, 1991; and PCT Application No. PCT/US91/00028, which is comprised verbatim of the '302 application and was published as WO 91/10377 on Jul. 25, 1991. This application develops the application of the concept of the theoretically ideal stability plane to other shoe structures.

The purpose of the theoretically ideal stability plane as described in these pending applications was primarily to provide a neutral design that allows for natural foot and ankle biomechanics as close as possible to that between the foot and the ground, and to avoid the serious interference with natural foot and ankle biomechanics inherent in existing shoes.

In its most general form, the concept of the theoretically ideal stability plane is that the thickness of contoured stability sides of shoe soles, typically measured in the frontal plane, should equal the thickness of the shoe sole underneath the foot. The pending applications listed above all use figures which show that concept applied to embodiments of shoe soles with heel lifts, since that feature is standard to almost all shoes. Moreover, the variation in the sagittal plane thickness caused by the heel lifts of those embodiments is one of the primary elements in the originality of the invention.

However, the theoretically ideal stability plane concept is more general than those specific prior embodiments. It is clear that the concept would apply just as effectively to shoes with unconventional sagittal plane variations, such as negative heel shoe soles, which are less thick in the heel than the forefoot. Such shoes are not common: the only such shoe with even temporarily widespread commercial success was the Earth Shoe, which has not been produced since the mid-1970's.

The lack of success of such shoes may well have been due to problems unrelated to the negative heel. For example, the -sole of the Earth Shoe was constructed of a material that was so firm that there was almost no forefoot flexibility in the plane, as is normally required to accommodate the human foot's flexibility there; in addition, the Earth Shoe sole was contoured to fit the natural shape of the wearer's load-bearing foot sole, but the rigid sole exaggerated any inexactness of fit between the wearer and the standard shoe size.

In contrast, a properly constructed-negative heel shoe sole may well have considerable value in compensating for the effect of the long term adverse effect of conventional shoes with heel lifts, such as high heel shoes. Consequently, effectively designed negative heel shoe soles could become more widespread in the future and, if so, their stability would be significantly improved by incorporating the theoretically ideal stability plane concept that is the basis of the applicant's prior inventions.

The stability.of flat shoe soles that have no heel lift, maintaining the same thickness throughout, would also be greatly improved by the application of the same theoretically ideal plane concept.

For the very simplest form of shoe sole, that of a Indian moccasin.of single or double sole, the standard test of originally would obviously preclude any claims of new invention. However, that simple design is severely limited in that it is only practical with very thin soles. With sole thickness that is typical, for example, of an athletic shoe, the moccasin design would have virtually no forefoot flexibility, and would obstruct that of the foot.

The inherent problem of the-moccasin design is that the U shape of the moccasin sole in the frontal plane creates a composite sagittal plane structure similar to a simple support beam designed for rigidity; the result is that any moccasin which is thick soled is consequently highly rigid in the horizontal plane.

The applicant's prior application Ser. No. 07/239,667, filed on Sep. 2, 1988, includes an element to counteract such unnatural rigidity: abbreviation of the contoured stability sides of the shoe sole to only essential structural support and propulsion elements. The essential structural support elements are the base and lateral tuberosity of the calcaneus, the heads of the metatarsals, and the base of the fifth metatarsal. The essential propulsion element is the head of the first distal phalange.

Abbreviation of the contoured sides of the shoe sole to only essential structural elements constitutes an original approach to providing natural flexibility to the double sole moccasin design, overcoming its inherent limitation of thin soles. As a result, it is possible to construct naturally stable shoe soles that are relatively thick as is conventional to provide good cushioning, particularly for athletic and walking shoes, and those shoe soles can be natural in the fullest sense; that is, without any unnatural heel lift, which is, of course, an invention dating from the Sixteenth Century.

Consequently, a flat shoe sole with abbreviated contour sides would be the most neutral design allowing for natural foot and ankle biomechahics as close as possible to that between the foot and the ground and would avoid the serious interference with natural foot and ankle biomechanics inherent in existing shoes. Such a shoe sole would have uniform thickness in the sagittal plane, not just the frontal plane.

Accordingly, it is a general object of this invention to elaborate upon the application of the principle of the theoretically ideal stability plane to other shoe structures.

It is another general object of this invention to provide a shoe sole which applies the theoretically ideal stability plane concept to provide natural stability to negative heel shoe soles that are less thick in the heel area than in the rest of the shoe sole.

It is still another object of this invention to provide a shoe sole which applies the theoretically ideal stability plane concept to flat shoe soles that have no heel lift, maintaining the same thickness throughout; excessive structural rigidity being avoided with contoured stability sides abbreviated to only essential structural support elements to provide the shoe sole with natural flexibility paralleling that of the human foot.

It is still another object of this invention to provide a shoe sole wherein the abbreviation of essential structural support elements can also be applied to negative heel shoe soles, again to avoid excessive rigidity and to provide natural flexibility.

These and other objects of the invention will become apparent from a detailed description of the invention which follows taken with the accompanying drawings.

BRIEF DESCRIPTION OF THE DRAWINGS

In the drawings:

FIG. 7 shows the applicant's new invention of the use of the theoretically ideal stability plane concept applied to a negative heel shoe sole that is less thick in the heel area than in the rest of the shoe sole.

FIGS. 7 and 8 disclose a shoe sole (28) having a sole inner surface (30) adjacent the location of an intended wearer's foot (27) inside the shoe including at least a first concavely rounded portion (43), as viewed in a frontal plane, the concavity being determined relative to the location of an intended wearer's foot (27) inside the shoe, during an upright, unloaded shoe condition. The shoe sole (28) further includes a lateral or medial sidemost section (45) defined by that part of the side of the shoe sole (28) located outside of a straight line (55) extending vertically from a sidemost extent (46) of the sole inner surface (30), as viewed in the frontal plane during a shoe upright, unloaded condition, an outer surface (31) extending from the sole inner surface (30) and defining the outer boundary of the sidemost section (45) of the side of the shoe sole (28), as viewed in the frontal plane. The shoe sole (28) further including a second concavely rounded portion (44) forming at least the outer sole surface (31) of the sidemost section (45), the concavity being determined relative to the location of an intended wearer's foot (27) inside the shoe, as viewed in the frontal plane during a shoe upright, unloaded condition. The second concavely rounded portion (44) extending through a sidemost extent (47) of the sole outer surface (31) of the sole sidemost section (45), as viewed in the frontal plane during an upright, unloaded condition. A forefoot area (50) of the shoe sole (28) has a greater thickness ($s+s^1$) than the thickness (s) of a heel area (51) of the shoe sole (28), as viewed in a sagittal plane, as shown in FIG. 8, during an unloaded, upright shoe condition. The shoe sole (28) also including a sole midtarsal area (52) located between the forefoot area (50) and the heel area (51).

FIGS. 7 and 8 also show a shoe sole (28) having a sole inner surface (30) adjacent the location of an intended wearer's foot (27) inside the shoe with at least a first concavely rounded portion (43), the concavity being determined relative to the location of an intended wearer's foot (27) inside the shoe, as viewed in a frontal plane in a heel area (51) of the shoe sole (28), during an upright, unloaded shoe condition. The shoe sole (28) also includes a sole outer surface (31) extending from the sole inner surface (30) and having at least a second concavely rounded portion (44), the concavity being determined relative to the location of an intended wearer's foot (27) inside the shoe, as viewed in the frontal plane in the heel area (51) during a shoe upright, unloaded condition. The second concavely rounded portion (44) extends to a height above a horizontal line (48) through the lowermost point of the same side of the shoe sole (28), as viewed in the frontal plane in the heel area (51) during an upright, unloaded shoe condition. The shoe sole (28) having a greater thickness ($s+s^1$) in a forefoot area (50) than the thickness (s) in a heel sole area (51), as viewed in a sagittal plane, as shown in FIG. 8, during a shoe upright, unloaded condition. The centerline (49) of the shoe sole (28) is shown in FIG. 7.

FIGS. 9A–9E shows the applicant's other new invention of the use of the theoretically ideal stability plane concept applied to a flat shoe sole that have no heel lift, maintaining the same thickness throughout, with contoured stability sides abbreviated to only essential structural support elements. FIG. 9A is a cross sectional view of the forefoot portion taken along lines 9A of FIG. 9D; FIG. 9B is a view taken along lines 9B of FIG. 9D; FIG. 9C is a view taken along the heel along lines 9C in FIG. 9D; FIG. 9D is a top view of the shoe sole with the sides that are abbreviated to essential structural support elements shown hatched; and FIG. 9E is a sagittal plane cross section.

DETAILED DESCRIPTION OF THE PREFERRED EMBODIMENTS

Figure 1:
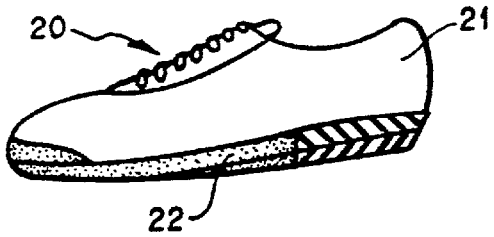
FIG. 1 (PRIOR ART)
FIG. 1 is a perspective view of a typical running shoe known to the prior art to which the invention is applicable.

FIG. 1 is a perspective view of an athletic shoe, such as a typical running shoe, according to the prior art, wherein a running shoe 20 includes an upper portion 21 and a sole 22.

Figure 2:
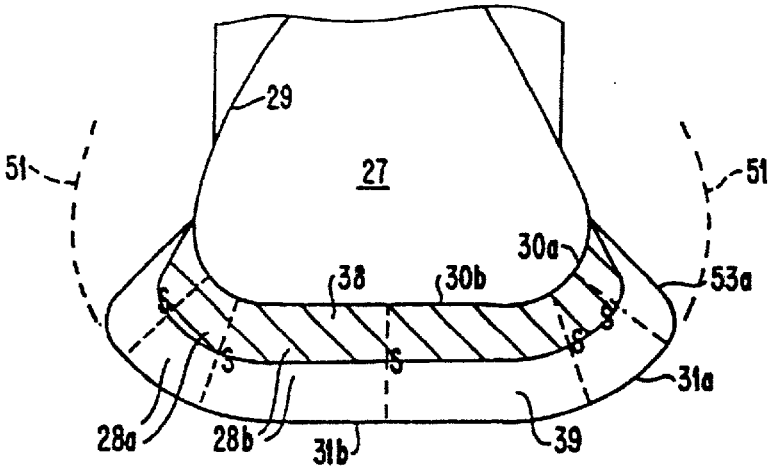
FIG. 2 shows, in frontal plane cross section at the heel portion of a shoe, the applicant's prior invention of a shoe sole with naturally contoured sides based on a theoretically ideal stability plane.
Figure 3:
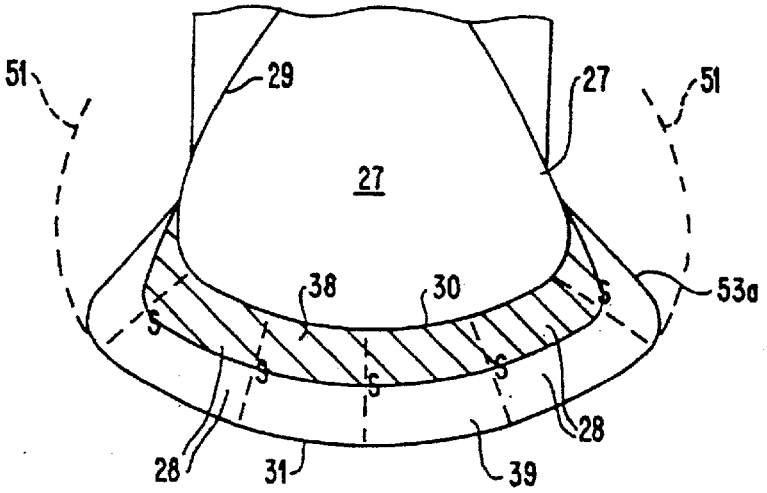
FIG. 3 shows, again in frontal plane cross section, the most general case of the applicant's prior invention, a fully contoured shoe sole that follows the natural contour of the bottom of the foot as well as its sides, also based on the theoretically ideal stability plane.
Figure 4:
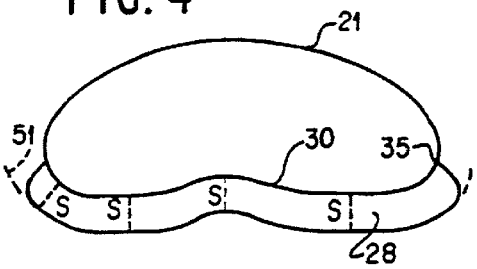
FIG. 4 shows, again in frontal plane cross section of the metatarsal or forefoot arch, an intermediate case of the applicant's prior invention, between those shown in FIGS. 3 and 4, wherein the naturally contoured sides design is extended to the other natural contours underneath the load-bearing foot; such contours include the main longitudinal arch.

FIGS. 2, 3, and 4 show frontal plane cross sectional views of a shoe sole according to the applicant's prior inventions based on the theoretically ideal stability plane, taken at about the ankle joint to show the heel section of the shoe. In the figures, a foot 27 is positioned in a naturally contoured shoe having an upper 21 and a sole 28. The concept of the theoretically ideal stability plane, as developed in the prior applications as noted, defines the plane 51 in terms of a locus of points determined by the thickness (s) of the sole. The reference numerals are like those used in the prior pending applications of the applicant mentioned above, as well as U.S. Patents now issued thereon, and which are incorporated by reference for the sake of completeness of disclosure, if necessary.

FIG. 2 shows, in a rear cross sectional view, the application of the prior invention, described in pending U.S. application Ser. No. 07/239,667, showing the inner surface of the shoe sole conforming to the natural contour of the load-bearing foot and the thickness of the shoe sole remaining constant in the frontal plane, so that the outer surface coincides with the theoretically ideal stability plane. In other words, the outer surface parallels the inner surface in the frontal plane.

FIG. 3 shows a fully contoured shoe sole design of the applicant's prior invention, described in the same pending application, that follows the natural contour of all of the foot, the bottom as well as the sides, while retaining a constant shoe sole thickness, which includes the heel lift or wedge 38 and combined midsole and outersole 39, in the frontal plane; again, the inner surface of the shoe sole that conforms to the shape of the foot is paralleled in the frontal plane by the outer surface of the bottom sole.

The fully contoured shoe sole assumes that the resulting slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 3 would deform by flattening to look essentially like FIG. 2. Seen in this light, the naturally contoured side design in FIG. 2 is a more conventional, conservative design that is a special case of the more general fully contoured design in FIG. 3, which is the closest to the natural form of the foot, but the least conventional. The amount of deformation flattening used in the FIG. 2 design, which obviously varies under different loads, is not an essential element of the applicant's invention.

FIGS. 2 and 3 both show in frontal plane cross sections the essential concept underlying this invention, the theoretically ideal stability plane, which is also theoretically ideal for efficient natural motion of all kinds, including running, jogging or walking. FIG. 3 shows the most general case of the invention, the fully contoured design, which conforms to the natural shape of the unloaded foot. For any given individual, the theoretically ideal stability plane 51 is determined, first, by the desired shoe sole thickness (s) in a frontal plane cross section, and, second, by the natural shape of the individual's foot surface 29.

For the special case shown in FIG. 2, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individual's load-bearing footprint 30*b*, which is defined as the upper surface of the shoe sole that is in physical contact with and supports the human foot sole.

The theoretically ideal stability plane for the special case is composed conceptually of two parts. Shown in FIG. 2, the first part is a line segment 31*b* of equal length and parallel to line 30*b* at a constant distance (s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the contoured side outer edge 31*a* is located at a distance which is exactly shoe sole thickness (s) from the closest point on the contoured side inner edge 30*a*; consequently, the inner and outer contoured edges 31*a* and 30*a* are by definition parallel.

In summary, the theoretically ideal stability plane is the essence of the applicant's prior invention because it is used to determine a geometrically precise bottom contour of the shoe sole based on a top contour that conforms to the contour of the foot. This prior invention specifically claims the exactly determined geometric relationship just described.

It can be stated unequivocally that any shoe sole contour, even of similar contour, that exceeds the theoretically ideal stability plane will restrict natural foot motion, while any less than that plane will degrade natural stability, in direct proportion to the amount of the deviation. The theoretical ideal was taken to be that which is closest to natural.

FIG. 4, also described in pending U.S. application Ser. No. 07/239,667, illustrates in frontal plane cross section the naturally contoured sides design extended to the other natural contours underneath the load-bearing foot; the metatarsal or forefoot arch is shown, but other such underneath contours include the main longitudinal arch and the ridge between the heads of the distal phalanges (toes).

Figure 5:
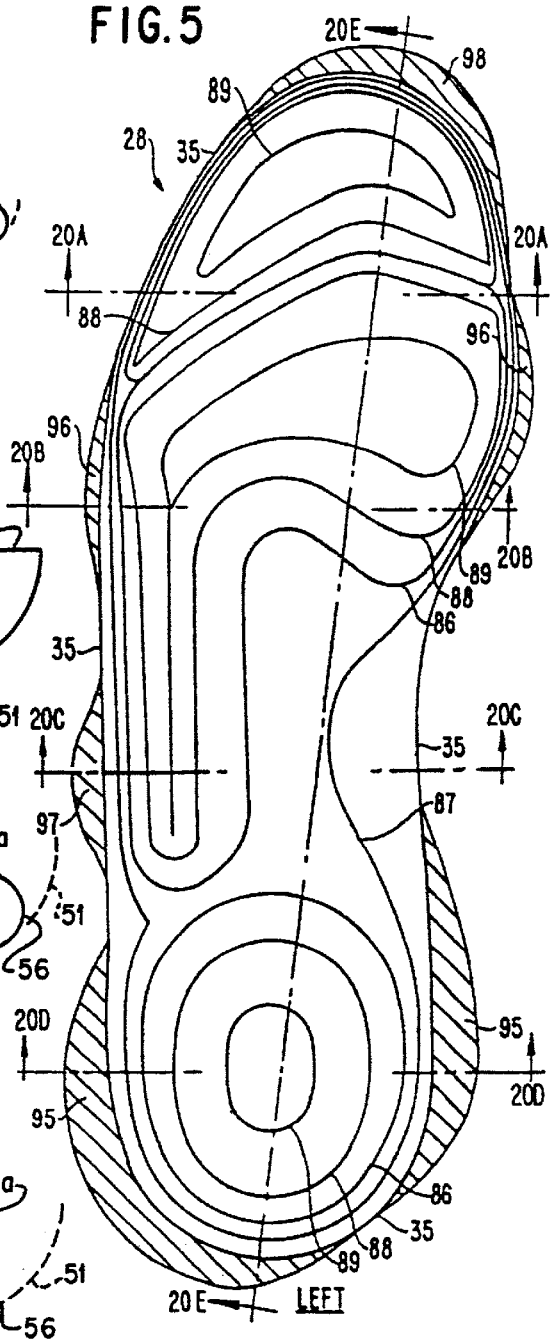
FIG. 5 shows in top view the applicant's prior invention of abbreviation of contoured sides to only essential structural support and propulsion elements (shown hatched), as.applied to the fully contoured design shown in FIG. 3.

FIG. 5 shows the applicant's prior invention of contour sides abbreviated to essential structural elements, also.described in pending U.S. application Ser. No. 07/239,667 now abandoned, as applied to the fully contoured design of FIG.

3. FIG. 5 shows.the horizontal plane top view of fully contoured shoe sole of the left foot abbreviated along the sides to only essential structural support,and propulsion elements (shown hatched). Shoe sole material density can be increased in the unabbreviated essential elements to compensate for increased pressure loading there. The essential structural support elements are the base and lateral tuberosity of the calcaneus 95, the heads of the metatarsals 96, and base of the fifth metatarsal 97. They must be supported both underneath and to the outside for stability. The essential propulsion element is the head of the first distal phalange 98. The medial (inside) and lateral (outside) sides supporting the base of the calcaneus are shown in FIG. 5 oriented along either side of the horizontal plane subtalar ankle joint axis, but can be located also more conventionally along the longitudinal axis of the shoe sole. FIG. 5 shows that the naturally contoured stability sides need not be used except in the identified essential areas. Weight savings and flexibility improvements can be.made by omitting the non-essential stability sides. Contour lines 85 through 89 show approximately the.relative height of the shoe sole contours within roughly the peripheral extent 36 of the undeformed load-bearing shoe sole 28*b*. A horizontal plane bottom view (not shown) of FIG. 5 would be the exact reciprocal or converse of FIG. 5 with the peaks and valleys contours exactly reversed.

Figure 6A:
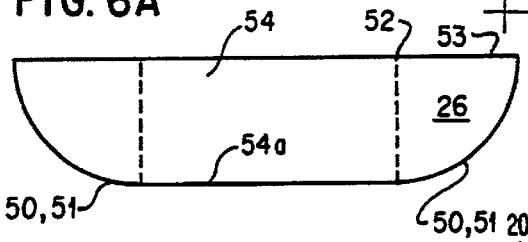
FIG. 6, as seen in FIGS. 6A to 6C in frontal plane cross section at the heel, shows the applicant's prior invention for conventional shoes, a quadrant-sided shoe sole, based on a theoretically ideal stability plane.
Figure 6B:
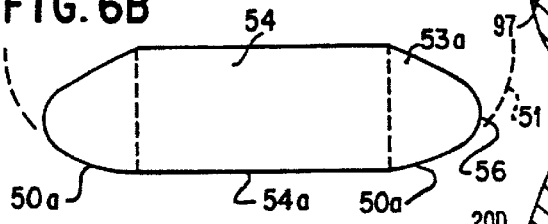
Figure 6C:
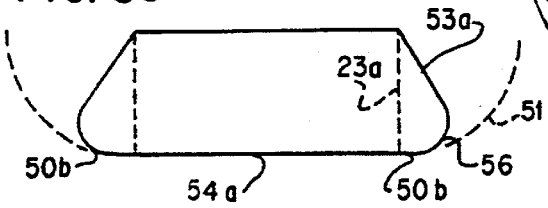

FIG. 6 illustrates in frontal plane cross section a final variation of the applicant's prior invention, described in pending U.S. application Ser. No. 07/219,387 now abandoned, that uses stabilizing quadrants 26 at the outer edge of a conventional shoe sole 28*b* illustrated generally at the reference numeral 28. The stabilizing quadrants would be abbreviated in actual embodiments as shown in FIGS. 6B and 6D.

FIG. 7 shows the applicant's new invention of using the theoretically ideal stability plane concept to provide natural stability in negative heel shoe soles that are less thick in the heel area than in the rest of the shoe sole; specifically, a negative heel version of the naturally contoured sides conforming to a load-bearing foot design shown in FIG. 2. As shown in the figures, the naturally contoured sides can extend up the sole.

Figure 7A:
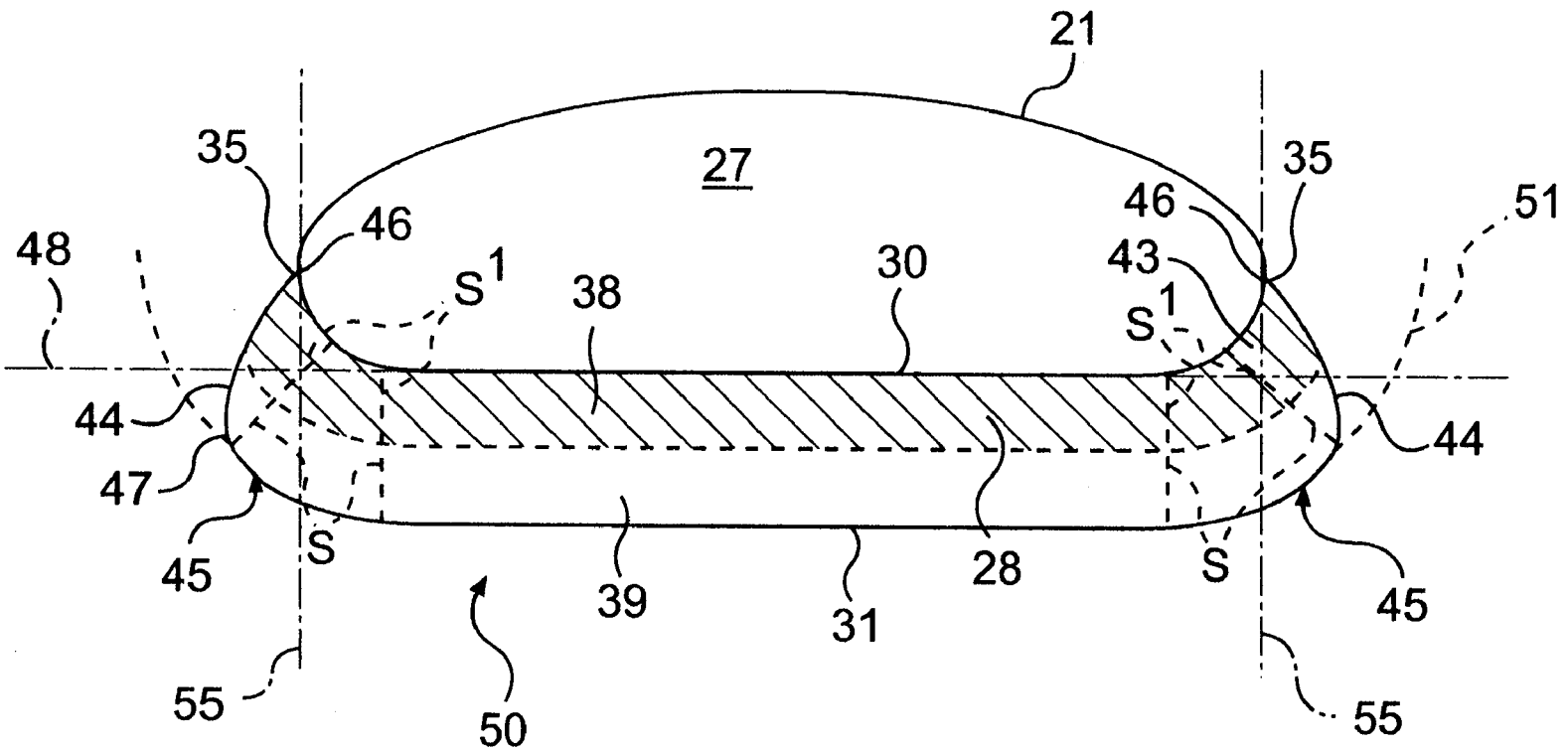
FIG. 7A is a cross sectional view of the forefoot portion taken along lines 7A of FIG. 7D.
Figure 7B:
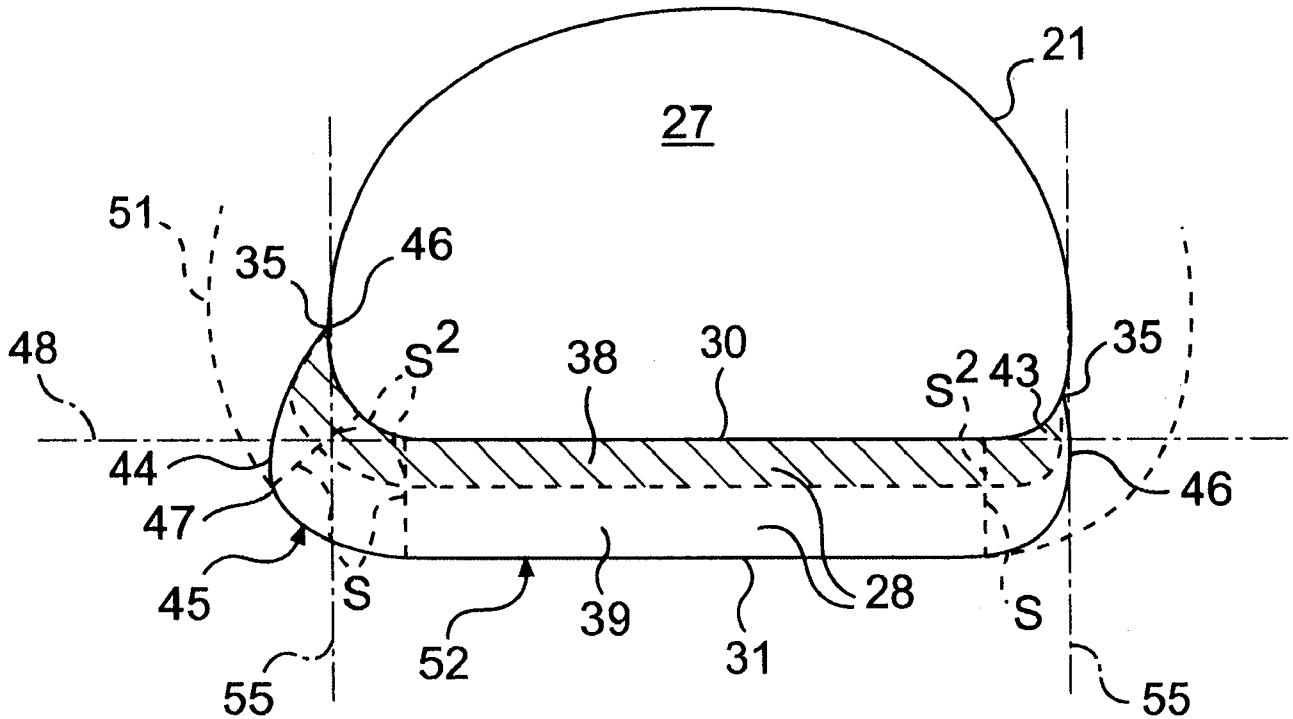
FIG. 7B is a view taken along lines 7B of FIG. 7D.
Figure 7C:
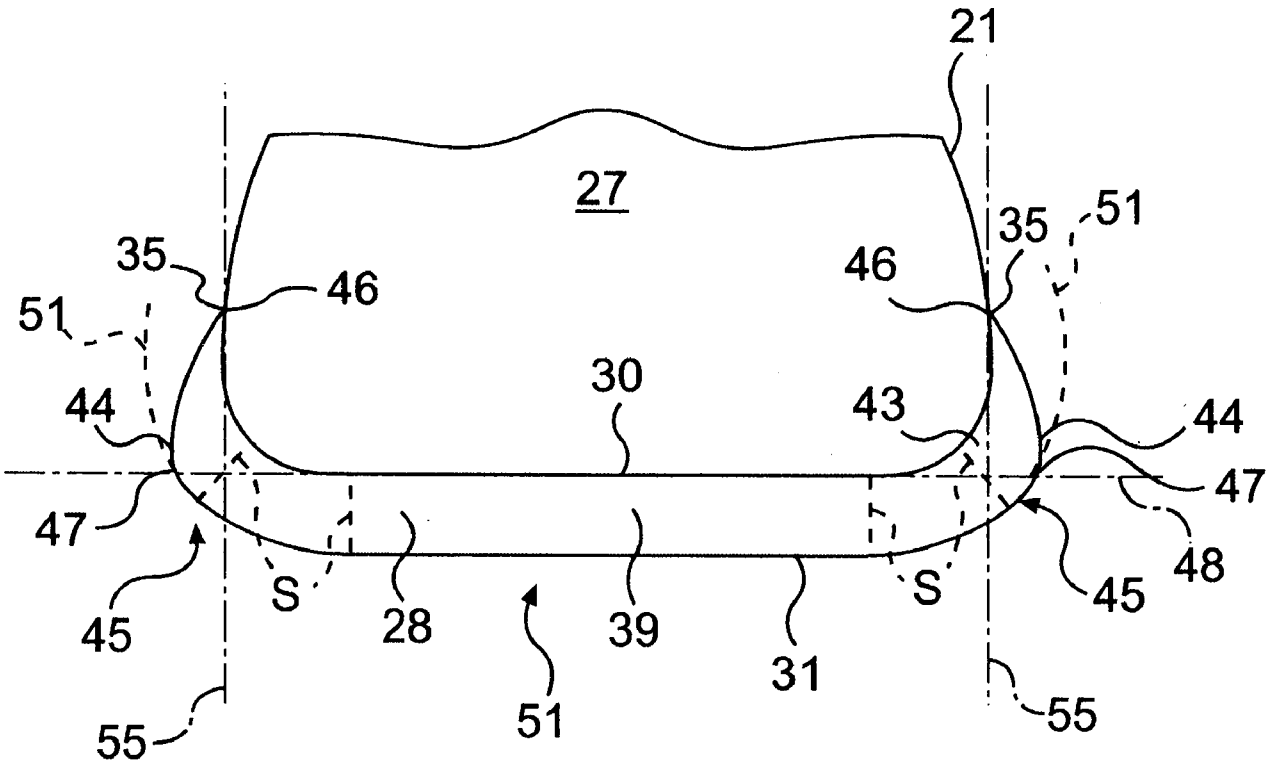
FIG. 7C is a view taken along the heel along lines 7C in FIG. 7D.
Figure 7D:
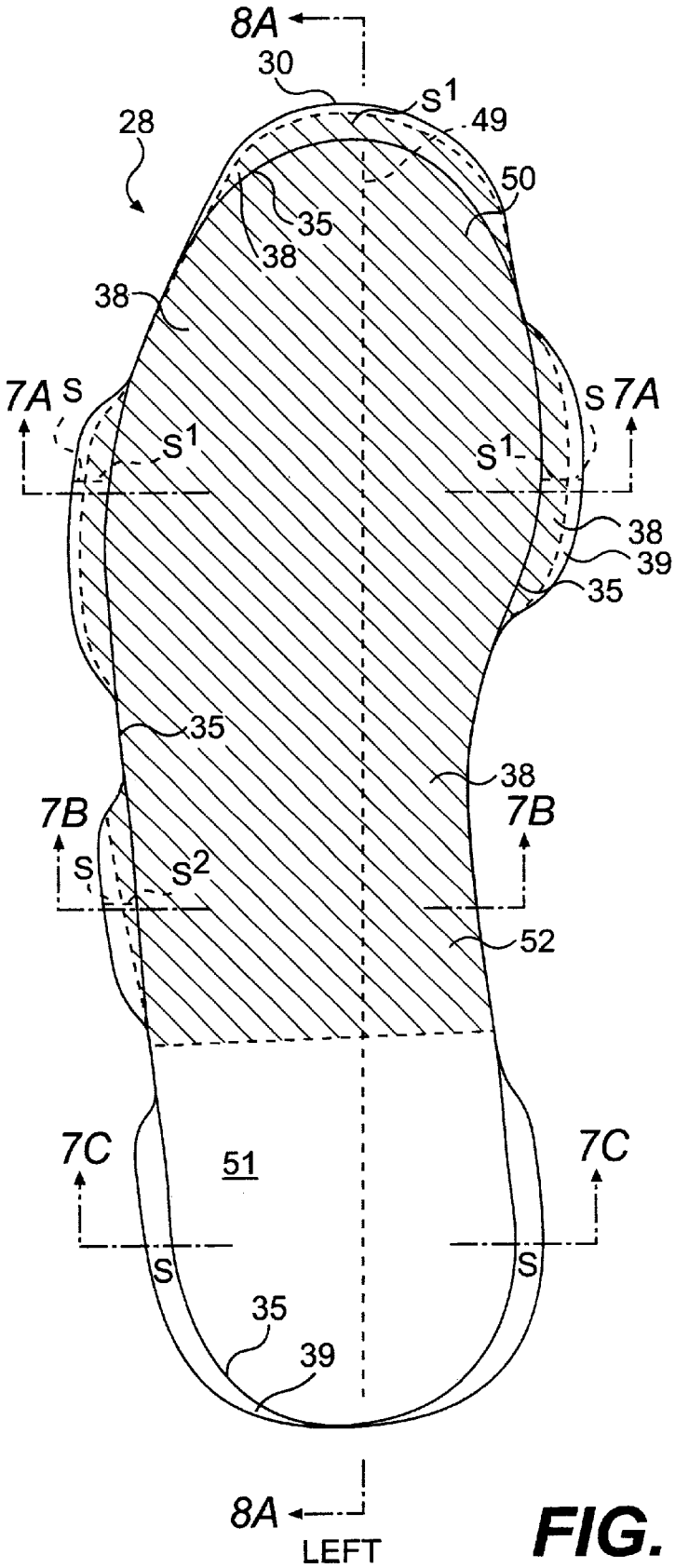
FIG. 7D is a top view of the shoe sole with the thicker forefoot section shown hatched.

FIGS. 7A, 7B and 7C represent frontal plane cross sections taken along the forefoot, at the base of the fifth metatarsal, and at the heel, thus illustrating that the shoe sole thickness is constant at each frontal plane cross section, even though that thickness varies from front to back, due to the sagittal plane variation 38 (shown hatched) causing a lower heel than forefoot, and that the thickness of the naturally contoured sides is equal to the shoe sole thickness in each FIGS. 7A–7C cross section. Moreover, in FIG. 7D, a horizontal plane overview or top view of the left foot sole, it can be seen that the horizontal contour of the sole follows the preferred principle in matching, as nearly as practical, the rough footprint of the load-bearing foot sole.

The abbreviation of essential structural support elements can also be applied to negative heel shoe soles such as that shown in FIG. 7 and dramatically improves their flexibility. Negative heel shoe soles such as FIG. 7 can also be modified by any of the applicant's prior inventions described in U.S. Pat. No. 4,989,349, issued Feb. 5, 1991 and U.S. Pat. No. 5,317,819, issued Jun. 7, 1994, as well as PCT applications published as International Publication Numbers WO 90/00358, published Jan. 25, 1990, WO 91/03180, published Mar. 21, 1991, WO 91/04683, published Apr. 18, 1991, WO 91/05491, published May 2, 1991, and WO 91/10377, published Jul. 25, 1991.

Figure 8A:
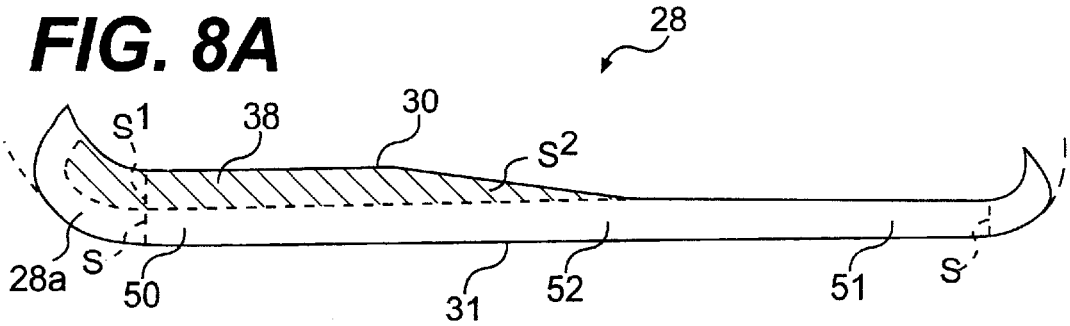
FIG. 8A shows the same embodiment as FIG. 7.
Figure 8B:
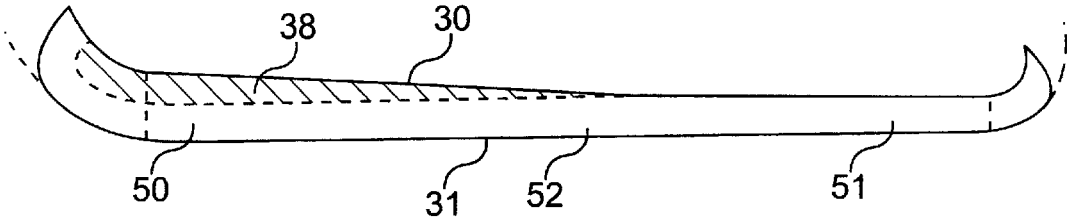
FIG. 8 shows, in FIGS. 8A–8E, a plurality of side sagittal plane cross sectional views of examples of negative heel sole thickness variations to which the general approach shown in FIG. 7 can be applied.
Figure 8C:
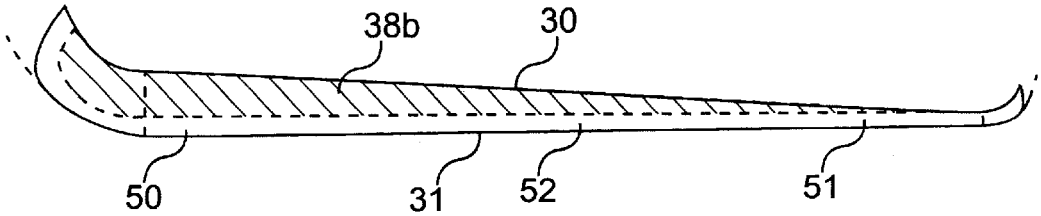
Figure 8D:
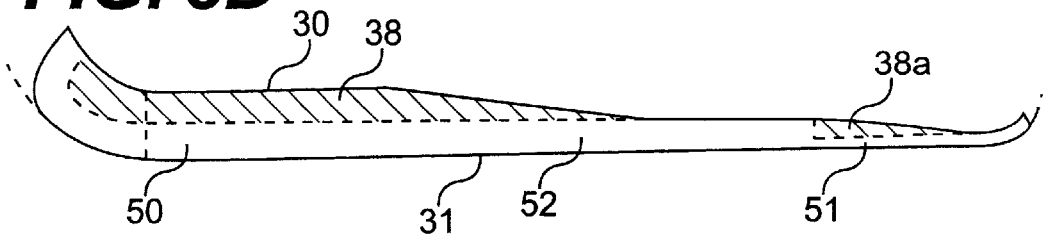
Figure 8E:
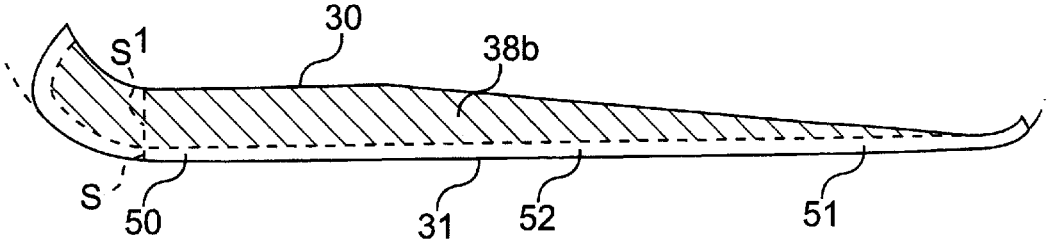

FIG. 8 shows, in FIGS. 8A–8D, possible sagittal plane shoe sole thickness variations for negative heel shoes. The hatched areas indicate the forefoot lift or wedge 38 and a combined midsole and outersole 39. At each point along the.shoe soles seen in sagittal plane cross sections, the thickness varies as shown in FIGS. 8A–8D, while the thickness of the naturally contoured sides 28*a*, as measured in the frontal plane, equal and therefore vary directly with those sagittal plane thickness variations. FIG. 8A shows the same embodiment as FIG. 7.

FIG. 9 shows the applicant's new invention of using the theoretically ideal stability plane concept to provide natural stability in flat shoe soles that have no heel lift, maintaining the same thickness throughout, with contoured stability sides abbreviated to only essential structural support elements to provide the shoe sole with natural flexibility paralleling that of the human foot.

FIGS. 9A, 9B and 9C represent frontal plane cross sections taken along the forefoot, at the base of the fifth metatarsal, and at the heel, thus illustrating that the shoe sole thickness is constant at each frontal plane cross section, while constant in the sagittal plane from front to back, so that the heel and forefoot have the same shoe sole thickness, and that the thickness of the naturally contoured sides is equal to the shoe sole thickness in each FIGS. 9A–9C cross section. Moreover, in FIG. 9D, a horizontal plane overview or top view of the left foot sole, it can be seen that the horizontal contour of the sole follows the preferred principle in matching, as nearly as practical, the rough footprint of the load-bearing foot sole. FIG. 9E, a sagittal plane cross section, shows that shoe sole thickness is constant in that plane.

FIG. 9 shows the applicant's prior invention of contour sides abbreviated to essential structural elements, as applied to a flat shoe sole. FIG. 9 shows the horizontal plane top view of fully, contoured shoe sole of the left foot abbreviated along the sides to only essential structural support and propulsion elements (shown hatched). Shoe sole material density can be increased in the unabbreviated essential elements to compensate for increased pressure loading there. The essential structural support elements are the base and lateral tuberosity of the calcaneus 95, the heads of the metatarsals 96, and base of the fifth metatarsal 97. They must be supported both underneath and to the outside for stability. The essential propulsion element is the head of the first distal phalange 98. The medial (inside) and lateral (outside) sides supporting the base and lateral tuberosity of the calcaneus are shown in FIG. 9 oriented in a conventional way along the longitudinal axis of the shoe sole, in.order to provide direct structural support to the base and lateral tuberosity of the calcaneus, but can be located also along either side of the horizontal plane subtalar ankle joint axis. FIG. 9 shows that the naturally contoured stability sides need not be used except in the identified essential areas. Weight savings and flexibility improvements can be made by omitting the non-essential stability sides. A horizontal plane bottom view (not shown) of FIG. 9 would be the exact reciprocal or converse of FIG. 9 with the peaks and valleys contours exactly reversed.

Flat shoe soles such as FIG. 9 can also be modified by any of the applicant's prior inventions described in pending U.S. application Ser. No. 07/219,387, filed on Jul. 15, 1988; Ser. No. 07/239,667, filed on Sep. 2, 1988; Ser. No. 07/400,714, filed on Aug. 30, 1989; Ser. No. 07/416,478, filed on Oct. 3, 1989, and Ser. No. 07/424,509, filed Oct. 20, 1989.

What is claimed is:

1. A shoe sole comprising:

a sole portion having an inner, foot sole-contacting surface;

at least one contoured side portion, merging with the sole portion and having an inner, foot sole-contacting surface conforming to the curved shape of at least a part of one side of the sole of an intended wearer's foot;

the shoe sole having a uniform thickness, when measured in frontal plane cross sections in all parts of the shoe sole intended to provide direct structural support between an intended wearer's load-bearing foot sole, when inside the shoe, and ground;

the parts of the shoe sole intended to provide direct structural support between an intended wearer's load-bearing foot sole and the ground include both that portion of the sole portion and that portion of the contoured side portion which become directly load-bearing when the shoe sole on the ground is tilted sideways, away from an upright position;

the uniform thickness of the shoe sole, as measured in a frontal plane cross section, extends through at least a contoured side portion intended to provide direct structural support between foot sole and ground through a sideways tilt of at least 30 degrees;

said shoe sole thickness being defined as the shortest distance bet ween any point on the inner, foot sole-contacting surface of said shoe sole and an outer surface of the parts of said shoe sole intended to provide direct structural support between an intended wearer's load-bearing foot sole and the ground, when measured in a frontal plane cross section;

said sole portion having a greater thickness in a forefoot area than in a heel area when measured in a sagittal plane cross section; and said thickness of the contoured side portion equaling and therefore varying directly with the thickness of the sole portion to which it is merged, when the thickness is measured in at least two frontal plane cross sections;

the uniform thickness of the shoe sole is different in at least two different frontal plane cross sections at locations where the shoe sole has a contoured side portion which is intended to provide direct structural support through a sideways tilt of the shoe sole of at least 30 degrees, so that there are at least two different contoured side portion thicknesses;

whereby, as measured in at least two frontal plane cross sections, the uniform thickness of the shoe sole, including the side portion, maintains a lateral stability of the intended wearer's foot on the shoe sole like that when the intended wearer's foot is bare on the ground, even during extreme sideways pronation and supination motion occurring when the shoe sole is in contact with the ground.

2. The shoe sole as set forth in claim 1, wherein said shoe sole is made of non-rigid material with sufficient flexibility to allow any portion, including a contoured portion, of the shoe sole directly between the load-bearing foot sole and the ground to deform by flattening under the wearer's body weight load like the sole of an intended wearer's foot when bare on the ground under substantially the same load;

as a result of the non-rigid material, the contoured shoe sole continues to conform to the shape of the wearer's foot sole even when both are deformed by flattening in parallel under a body weight load; and the flexibility of the shoe sole thereby maintains the flattened lower surface of the load-bearing foot sole at a substantially uniform distance from the ground, as viewed in a frontal plane cross section;

whereby the intended wearer's contoured foot sole, when under a weight-bearing load on the ground, deforms to flatten on the upper surface of the flexible shoe sole in substantially the same manner as it would if the foot were bare on the ground surface, as viewed in a frontal plane cross section, since the shoe sole which is contoured in parallel with the foot sole flexes to deform in parallel with the foot sole, thereby providing a wide area of stable foot support contact.

3. The shoe sole as set forth in claim 1, wherein said contoured side portion merges with at least a sole portion proximate to the location of at least one of the following bones of an intended wearer's foot when inside the shoe: a head of the fifth metatarsal, a base of the fifth metatarsal, a lateral tuberosity of th e calcaneus, a base of the calcaneus, a head of the first metatarsal, and a head of the first distal phalange.

4. The shoe sole set forth in claim 1, wherein said contoured side portion merges with at least a sole portion proximate to the location of at least two of the following bones of an intended wearer's foot when inside the shoe: a head of the fifth metatarsal, a base of the fifth metatarsal, a lateral tuberosity of the calcaneus, a base of the calcaneus, a head of the first metatarsal, and a head of the first distal phalange.

5. The shoe sole as set forth in claim 1, wherein said contoured side portion merges with at least a sole portion proximate to the location of at least three of the following bones of an intended wearer's foot when inside the shoe: a head of the fifth metatarsal, a base of the fifth metatarsal, a lateral tuberosity of the calcaneus, a base of the calcaneus, a head of the first metatarsal, and a head of the first distal phalange.

6. The shoe sole as set forth in claim 1, wherein said contoured side portion merges with at least a medial sole portion proximate to the location of at least four of the following bones of an intended wearer's foot when inside the shoe: a head of the fifth metatarsal, a base of the fifth metatarsal, a lateral tuberosity of the calcaneus, a base of the calcaneus, a head of the first metatarsal, and a head of the first distal phalange.

7. The shoe sole set forth in claim 1, wherein said contoured side portion merges with at least a sole portion proximate to the location of at least five of the following bones of an intended wearer's foot when inside the shoe: a head of the fifth metatarsal, a base of the fifth metatarsal,a lateral tuberosity of the calcaneus, a base of the calcaneus, a head of the first metatarsal, and a head of the first distal phalange.

8. The shoe sole as set forth in claim 1, wherein said contoured portion merges with at least a sole portion proximate to the location of at least a head of the fifth metatarsal and a head of the first metatarsal of [the] an intended wearer's foot when inside the shoe.

9. The shoe sole as set forth in claim 1, comprising at least two contoured side portions, one proximate to the location of the head of the first metatarsal and one proximate to the first distal phalange of an intended wearer's foot when inside the shoe; and said contoured side portions are separated by an area, including at least a frontal plane cross section, of the shoe sole extending through a sideways tilt of at least 30 degrees with no contoured side portion, said non-contoured side portion having a uniform thickness when measured in the frontal plane cross section included therein, in order to save weight and increase flexibility.

10. The shoe sole as set forth in claim 1, comprising at least two contoured side portions separated by a sole portion the sole portion being merged with a contoured side portion that has a thickness which is less than the thickness of the sole portion, in order to save weight and to increase flexibility;

the contoured side portion and sole portion thicknesses being measured in a frontal plane cross section.

11. The shoe sole construction as set forth in claim 1, comprising contoured side portions located at least at locations on the shoe sole proximate to the locations of the following support and propulsion elements of an intended wearer's foot when inside the shoe: a base and a lateral tuberosity of the calcaneus, a head of the first metatarsal, a head of the fifth metatarsal, a base of the fifth metatarsal, and a head of the first distal phalange, to thereby provide said shoe sole with flexibility and stability paralleling the foot sole flexibility and stability of an intended wearer's foot.

12. The shoe sole as set forth in claim 1, wherein at least a substantial portion of the inner surface of said sole portion conforms to the contours of the sole of the load-bearing foot of the wearer.

13. The shoe sole construction as set forth in claim 1, wherein at least a substantial portion of the inner surface of said sole portion conforms to the contour of the bottom of an intended wearer's foot sole when not under a load.

14. The shoe sole as set forth in claim 1, wherein the surface of said sole portion is substantially flat.

15. The shoe sole as set forth in claim 1, wherein the at least one contoured side portion with uniform thickness which is merged with said shoe sole portion, is sufficient to maintain lateral stability of an intended wearer's foot throughout its full range of sideways motion by providing structural support directly between all portions of the intended wearer's load-bearing foot sole and the ground, including at least at least 20 degrees of inversion of an intended wearer's heel when inside the shoe;

the uniform thickness of the shoe sole extends through contoured side portions providing direct structural support at least beyond the load-bearing portions of the foot sole, so that the uniform thickness of the conforming shoe sole structure maintains a firm lateral stability substantially equivalent to that of an intended wearer's foot when bare.

16. The shoe sole as set forth in claim 1, wherein the uniform thickness of the shoe sole extends through at least part of a contoured side portion providing direct structural support between an intended wearer's foot sole, when inside the shoe, and ground through a sideways tilt of at least 45 degrees.

* * * * *